US009611447B2

(12) United States Patent
Pey Gutiérrez et al.

(10) Patent No.: US 9,611,447 B2
(45) Date of Patent: Apr. 4, 2017

(54) LIQUID DETERGENT COMPOSITION COMPRISING AN ETHOXYLATED GLYCEROL COMPOUND

(71) Applicant: KAO CORPORATION, S.A., Barberá del Vallés (Barcelona) (ES)

(72) Inventors: Carmen Ma Pey Gutiérrez, Barberá del Vallés (ES); Blanca Nogués López, Barberá del Vallés (ES)

(73) Assignee: KAO CORPORATION, S.A., Barbera Del Valles (Barcelona) (ES)

( * ) Notice: Subject to any disclaimer, the term of this patent is extended or adjusted under 35 U.S.C. 154(b) by 0 days.

(21) Appl. No.: 14/898,671

(22) PCT Filed: Jun. 27, 2014

(86) PCT No.: PCT/ES2014/070529
§ 371 (c)(1),
(2) Date: Dec. 15, 2015

(87) PCT Pub. No.: WO2014/207286
PCT Pub. Date: Dec. 31, 2014

(65) Prior Publication Data

US 2016/0130530 A1 May 12, 2016

(30) Foreign Application Priority Data

Jun. 28, 2013 (ES) ..... 201330978

(51) Int. Cl.

| | |
|---|---|
| ***C11D 1/29*** | (2006.01) |
| ***C11D 1/83*** | (2006.01) |
| ***C11D 3/386*** | (2006.01) |
| ***C11D 3/42*** | (2006.01) |
| ***C11D 3/20*** | (2006.01) |
| ***C11D 3/43*** | (2006.01) |
| ***C11D 17/04*** | (2006.01) |
| ***C11D 1/12*** | (2006.01) |
| ***C11D 1/22*** | (2006.01) |

(52) U.S. Cl.
CPC ..... *C11D 3/2068* (2013.01); *C11D 1/12* (2013.01); *C11D 1/22* (2013.01); *C11D 3/2089* (2013.01); *C11D 3/43* (2013.01); *C11D 17/043* (2013.01); *C11D 3/2065* (2013.01)

(58) Field of Classification Search
CPC .. C11D 1/29; C11D 1/83; C11D 1/667; C11D 3/2065; C11D 3/386; C11D 3/42; C11D 7/5004; C11D 11/0017; C11D 17/0004; C11D 17/042
See application file for complete search history.

(56) References Cited

U.S. PATENT DOCUMENTS

| | | | | | |
|---|---|---|---|---|---|
| 5,646,104 | A * | 7/1997 | Erilli | C11D 1/146 | 510/101 |
| 6,025,318 | A * | 2/2000 | Mertens | C11D 1/83 | 510/101 |
| 6,034,049 | A * | 3/2000 | Erilli | C11D 1/146 | 510/101 |

FOREIGN PATENT DOCUMENTS

| | | |
|---|---|---|
| EP | 1120459 | 8/2001 |
| EP | 1516917 | 3/2005 |
| EP | 2441824 | 4/2012 |
| EP | 22441824 | 4/2012 |
| ES | 2069401 T3 | 5/1995 |
| ES | 32069401 | 5/1995 |
| ES | 2250446 T3 | 4/2006 |
| ES | 42250446 | 4/2006 |
| ES | 2256818 T3 | 7/2006 |
| ES | 62256818 | 7/2006 |
| ES | 2262789 T3 | 12/2006 |
| ES | 52262789 | 12/2006 |

OTHER PUBLICATIONS

International Search Report issued by the International Searching Authority (ISA/O.E.P.M.) on Sep. 23, 2014 in connection with International Application No. PCT/ES2014/070529.
International Search Report issued by the International Searching Authority (ISA/O.E.P.M.) on Sep. 23, 2014 in connection with International Application No. PCT/ES2014/070629.

* cited by examiner

*Primary Examiner* — Charles Boyer
(74) *Attorney, Agent, or Firm* — Gary J. Gershik; Cooper & Dunham LLP

(57) ABSTRACT

The invention relates to a liquid detergent composition comprising at least one anionic surfactant, at least one ethoxylated glycerol compound, at least one organic solvent comprising glycerol, an amount of water not more than 10% by weight in relation to the entirety of the detergent composition, and optionally, a partially or fully neutralized fatty acid. Said composition is suitable for use in unit doses which also comprise a water-soluble capsule for washing clothes. The invention also relates to said unit dose and to methods for producing the composition and the unit dose.

16 Claims, No Drawings

LIQUID DETERGENT COMPOSITION COMPRISING AN ETHOXYLATED GLYCEROL COMPOUND

TECHNICAL FIELD

The present invention relates to a liquid detergent composition for machine washing clothes, to liquid unit doses comprising said liquid detergent composition and water-soluble capsules, as well as to methods for producing the detergent and the liquid unit doses.

STATE OF THE ART

Detergent compositions for washing clothes available on the market are mainly classified into two types according to their physical appearance: conventional liquid detergents, with a water content of 90, 50, or even 30% by weight according to whether or not they are standard formulas or concentrated formulas; and powder detergents, both in solid form and with very little water. Liquid formulations are usually more suitable for washing clothes at moderate temperatures, given that they more readily disperse in water and given that the components thereof are gentler on fabrics. Both powder formulations and liquid formulations require the end user to meter out the formulations and introduce them into the washing machine. Part of the product often stays in the washing machine detergent chamber or in the conduits leading said product to the drum. One of the most recent innovations in this respect has been the emergence of formats in single-dose units, having the advantage for consumers and users of being easier to handle and meter than conventional formats, and they can be introduced directly into the drum of the washing machine.

In the case of liquid detergents, the single-dose or unit dose format is based on the use of concentrated liquid formulas packaged in water-soluble capsules. The main specific technical requirement of liquid detergent formulations suitable for such use is a low water content (condition necessary for preventing capsule dissolution which must take place while washing upon contact with water).

Formulating detergent compositions with low water content is a technically complex challenge that often entails problems in connection with preparation of suitable formulations of the ingredients, i.e., the suitable incorporation and miscibility of such ingredients in a homogenous, stable composition without cloudiness issues and suitable viscosity. One of the solutions adopted to make non-miscible ingredients compatible is the use of capsules with designs minimizing the interaction between such ingredients. For example, international patent application WO2003052042 describes a liquid detergent composition contained in package in the shape of a polyhedron, preferably a tetrahedron. The composition comprises at least two layers, hydrophilic and hydrophobic, with the hydrophobic layer preferably on top. By virtue of the shape of the package, the interface between the top layer and the next lower layer is minimized, which in turn leads to a reduced interaction between the two layers, resulting in the increased stability of the ingredient in the top layer.

It should be mentioned that use of special designs in connection with the structure/shape of the capsule usually entails greater complexity in the process of manufacturing the capsule, and accordingly additional economic costs.

Another solution adopted to overcome said problems is the incorporation of solvents in the formulations. For example, the publication EP1120459 describes a detergent formula suitable for washing clothes comprising a substantially anhydrous isotropic liquid detergent formulation encapsulated in water soluble film based on polyvinyl alcohol. The formulation is characterized by the use of propylene glycol, (non-renewable source material), an alkanolamine and ethanol (a compound organic volatile), and by the preferred use of ethoxylated C13/C15 fatty alcohol type surfactants (a surfactant with a hydrocarbon chain that is not of plant/animal origin). The solution described in said publication is among one of the most widely used solutions for solving the problem of detergent formula ingredient miscibility in a virtually non-aqueous medium. In fact, most concentrated liquid detergents on the market in water-soluble capsule format are based on the use of propylene glycol and alkanolamines having a low molecular weight (particularly monoethanolamine or triethanolamine) as solvents and ethoxylated C13/C15 alcohol. However, it would be desirable to have formulations based on renewable source materials.

There are some approaches to more sustainable formulations, such as the approach described in patent application publication EP2441824 A1. Said publication relates to compositions free of volatile organic compounds. The term "volatile organic compounds" refers to organic chemical compounds characterized by significant vapor pressures. The voce are generally not very toxic, but given their volatile, liposoluble and inflammable character, they can affect the environment and human health, producing chronic effects. In that sense, EP2441824 A1 relates to a liquid cleaning composition comprising (i) at least one nonionic surfactant, (ii) at least one anionic surfactant, (iii) at least one non-aqueous solvent, and (iv) water, accordingly characterized in that the water content is less than 10% by weight. The invention particularly relates to the use of nonionic surfactants of the type alkyl(oligo)glycosides and/or ethoxylated fatty alcohols. However, the examples specify the use of a solvent formed by the mixture off glycerol, propylene glycol and monoethanolamine in proportions in which the glycerol:(propylene glycol+monoethanolamine) ratio does not exceed 1.1:1.

Furthermore, patent publication EP1516917 is an example of the relevant state of the art for the present invention. The authors describe the problem associated with non-aqueous detergent compositions or detergent compositions with low water content, and they mention the drawbacks associated with the use of large amounts of expensive, non-aqueous solvents necessary for keeping a single-phase liquid fluid and homogenous. They particularly stress the fact that although fatty acids provide important cleaning advantages, it is difficult to incorporate high levels of fatty acids in single-phase, low water content, liquid unit dose compositions due to their limited solubility. The technical problem addressed is solved by neutralizing the liquid detergent composition such that the composition comprises a combination of non-neutralized soap and neutralized soap. The soap:neutralized soap molar ratio is 5:1 to 1:5, preferably 1:1 to 1:5.

Based on the foregoing, there is a need for liquid detergent compositions with compositions suitable for single-dose water-soluble capsules having suitable detergency in a wide range of programs

BRIEF DESCRIPTION OF THE INVENTION

In the field of liquid detergent compositions for water-soluble capsules, there is a need to have compositions with a low water content, with an effective detergent surfactant system, such compositions being homogenous, stable compositions without cloudiness issues, preferably transparent, capable of being dispersed in water at moderate temperatures and even in cold water with sufficient speed and based on ingredients fundamentally from renewable sources (raw materials from an animal and/or plant origin). The present invention provides an efficient solution to the aforementioned requirements, providing a liquid detergent composition for washing clothes capable of meeting different technical requirements in connection with liquid compositions for water-soluble capsules as well as environmental requirements:

- Water content less than 10%
- Stable and transparent formulas
- Compositions dispersible in water at room temperature and in cold water at a high enough speed
- Suitable detergency
- Reduction of non-renewable source solvents
- Use of nonionic surfactants from a fundamentally natural source (hydrocarbon structure of plant/animal origin)

Therefore, in one aspect the present invention provides a liquid detergent composition comprising:

a) at least one anionic surfactant, b) at least one ethoxylated glycerol compound comprising at least one component of formula (II)

(II)

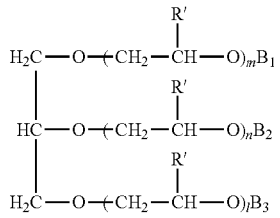

as defined herein, c) at least one organic solvent comprising c1. glycerol c2. optionally one or more organic solvents other than glycerol d) an amount of water not more than 10% by weight in relation to the entirety of the detergent composition, e) optionally, a partially or fully neutralized fatty acid.

In another aspect, the present invention also provides a method for preparing the liquid detergent compositions according to the invention. Said method comprises mixing the components of the composition of the invention at a temperature suitable for homogenization thereof, preferably at room temperature.

The present invention also provides a liquid unit dose comprising a water-soluble capsule with at least one compartment and a liquid housed therein, characterized in that said liquid is the liquid detergent composition according to the invention.

The present invention also provides a method for preparing a liquid unit dose according to the invention. Said method comprises encapsulating the liquid detergent composition of the invention in a water-soluble capsule.

The present invention also provides a method for cleaning clothes which comprises using water-soluble capsules containing a liquid detergent composition according to the invention.

The present invention also provides the use of the liquid unit doses of the invention for cleaning clothes.

DETAILED DESCRIPTION OF THE INVENTION

The present invention relates to a liquid detergent composition comprising:

a) at least one anionic surfactant, b) at least one ethoxylated glycerol compound comprising at least one component of formula (II)

(II)

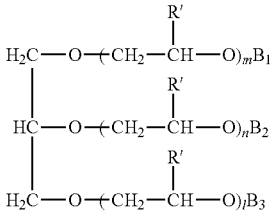

as defined herein, c) at least one organic solvent comprising c1. glycerol c2. optionally one or more organic solvents other than glycerol d) an amount of water not more than 10% by weight in relation to the entirety of the detergent composition, e) optionally, a partially or fully neutralized fatty acid.

a) Anionic Surfactant

The present invention comprises a component (a) comprising at least one anionic surfactant.

According to the present invention, said anionic surfactant is preferably selected from the group consisting of alkyl aryl sulfonates, alkyl ester sulfonates, primary or secondary alkene sulfonates, alkyl sulfates, alkyl ether sulfates, alkyl ether carboxylic acids and/or their salts and sulfosuccinates, or mixtures thereof, preferably alkyl ether sulfates, alkyl ether carboxylic acids and and/or their salts and sulfosuccinates, more preferably alkyl ether sulfates.

As anionic surfactants of the alkyl aryl sulfonate type are preferred the alkaline metal salts or alkanolamines of alkylbenzene sulfonates. The alkylbenzene sulfonate alkyl group preferably contains 8 to 16 carbon atoms and more preferably 10 to 15 carbon atoms. A particularly preferred alkylbenzene sulfonate is dodecylbenzene sulfonate.

An example of a commercially available alkylbenzene sulfonate type anionic surfactant is the surfactant with commercial reference SULFONAX® (INCI name dodecylbenzene sulfonic acid), containing 95% active ingredients and marketed by KAO Chemicals Europe.

$C_6$-$C_{22}$ alkyl sulfates are preferred as alkyl sulfate type anionic surfactants, being able to use metal salts of said $C_6$-$C_{22}$ alkyl sulfates as well as ammonium salts or organic amine salts with alkyl or hydroxyalkyl substituents. Alkyl sulfates with an alkyl chain containing between 10 and 18 carbon atoms, more preferably between 12 and 16 carbon atoms, are preferred. Sodium lauryl sulfate, potassium lauryl sulfate, ammonium lauryl sulfate and mono-, di- and triethanolamine lauryl sulfates, or mixtures thereof, are particularly preferred.

Examples of commercially available alkyl sulfate type anionic surfactants are the surfactants with commercial references EMAL® 10N or EMAL® 10G, (INCI name Sodium Lauryl Sulfate), containing 95% active ingredient, EMAL® 30E (INCI name Sodium Lauryl Sulfate), containing 30% active ingredient, and EMAL® 40TE (INCI name TEA Lauryl Sulfate), containing 40% active ingredient, all of which are marketed by KAO Chemicals Europe.

$C_6$-$C_{22}$ alkyl ether sulfates containing from 0.5 to 5, preferably from 0.8 to 3 moles of ethylene oxide, are preferred as alkyl ether sulfate type anionic surfactants, being able to use metal salts of said $C_6$-$C_{22}$ alkyl ether sulfates as well as ammonium salts or organic amine salts with alkyl or hydroxyalkyl substituents. Alkyl ether sulfates with an alkyl chain containing between 10 and 18 carbon atoms, more preferably between 12 and 16 carbon atoms, and containing from 0.5 to 5, preferably from 0.8 to 3 moles of ethylene oxide, are preferred.

Sodium laureth sulfate, potassium laureth sulfate, ammonium laureth sulfate and of mono-, di- and triethanolamine laureth sulfates, containing from 0.8 to 3 moles of ethylene oxide, or mixtures thereof, are particularly preferred.

Examples of commercially available alkyl ether sulfate type anionic surfactants are the surfactants with commercial reference EMAL® 270D or EMAL® 270E (INCI name Sodium Laureth Sulfate), containing 70% active ingredient and with a mean degree of ethoxylation of 2, EMAL® 227D or EMAL® 227E (INCI name Sodium Laureth Sulfate), containing 27% active ingredient and with a mean degree of ethoxylation of 2, all of which are marketed by KAO Chemicals Europe.

Alkyl ether carboxylic acids and/or their salts containing from 0.5 to 15, preferably from 2 to 12 moles of ethylene oxide, are preferred as anionic surfactants of the type comprising alkyl ether carboxylic acid and/or its salts, being able to use metal salts of said $C_6$-$C_{22}$ alkyl ether carboxylic acids as well as ammonium salts or organic amine salts with alkyl or hydroxyalkyl substituents.

Alkyl ether carboxylic acids and/or their salts with an alkyl chain containing between 10 and 18 carbon atoms, more preferably between 12 and 18 carbon atoms, and containing from 0.5 to 15, preferably from 2 to 12 moles of ethylene oxide, are preferred.

Laureth carboxylic acid, sodium laureth carboxylate, potassium laureth carboxylate, ammonium laureth carboxylate, myristyl ether carboxylic acid, sodium myristyl ether carboxylate, potassium myristyl ether carboxylate and ammonium myristyl ether carboxylate, containing from 2 to 12 moles of ethylene oxide, or technical mixtures thereof, are particularly preferred.

Examples of anionic surfactants of the type comprising commercially available alkyl ether carboxylic acid and/or its salts are the surfactants with commercial reference AKYPO® RLM 25 CA (INCI name Laureth-4 Carboxylic Acid), AKYPO® RIM 45 N (INCI name Sodium Laureth-6 Carboxylate), AKYPO® SOFT 45 NV (INCI name Sodium Laureth-6 Carboxylate), AKYPO® RLM 70 (INCI name Laureth-8 Carboxylic Acid), AKYPO® RLM 100 (INCI name Laureth-11 Carboxylic Acid), AKYPO® SOFT 100 BVC (INCI name Sodium Laureth-11 Carboxylate), all of which are marketed by KAO Chemicals Europe.

$C_6$-$C_{66}$ mono- and dialkyl sulfosuccinates and $C_6$-$C_{22}$ mono- and dialkyl ether sulfosuccinates containing from 0.5 to 10, preferably from 1 to 5 moles of ethylene oxide, or mixtures thereof, are preferred as sulfosuccinate type anionic surfactants, being able to use metal salts of said $C_6$-$C_{22}$ mono- and dialkyl sulfosuccinates and $C_6$-$C_{22}$ mono- and dialkyl ether sulfosuccinates as well as ammonium salts or organic amine salts with alkyl or hydroxyalkyl substituents.

Mono- and dialkyl sulfosuccinates and mono- and dialkyl ether sulfosuccinates with alkyl chains containing between 8 and 18 carbon atoms, more preferably between 12 and 18 carbon atoms, are preferred.

Dioctyl sodium sulfosuccinate, dioctyl potassium sulfosuccinate, bis(2-ethylhexyl) sodium sulfosuccinate, bis(2-ethylhexyl) potassium sulfosuccinate, diisotridecyl sodium sulfosuccinate, diisotridecyl potassium sulfosuccinate, disodium monolaureth sulfosuccinate containing from 0.5 to 5 moles of ethylene, and dipotassium monolaureth sulfosuccinate containing from 0.5 to 5 moles of ethylene, or mixtures thereof, are particularly preferred. Disodium monolaureth sulfosuccinate containing from 0.5 to 5 moles of ethylene and dipotassium monolaureth sulfosuccinate containing from 0.5 to 5 moles of ethylene, or mixtures thereof, are even more preferred.

Examples of commercially available sulfosuccinate type anionic surfactants are the surfactants with commercial reference SUCCIDET® NES or SUCCIDET® S 30 (INCI name Disodium Laureth Sulfosuccinate), marketed by KAO Chemicals Europe.

b) Ethoxylated Glycerol Compounds

The present invention comprises an ethoxylated glycerol compound component b) comprising at least one component of formula (II).

(II)

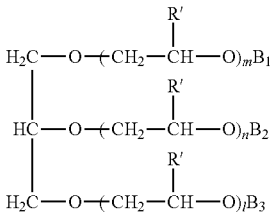

where said formula (II) comprises the components of formula i), ii), iii) and/or iv), wherein i) is a component represented by formula (II), where one of the symbols $B_1$, $B_2$, $B_3$ independently represents an acyl group represented by —CO—R and the moiety represents H ii) is a component represented by formula (II), where two of the symbols $B_1$, $B_2$, $B_3$ independently represent an acyl group represented by —CO—R and the moiety represents H;

iii) is a component represented by formula (II), where each of the symbols $B_1$, $B_2$, $B_3$ independently represents an acyl group represented by —CO—R;

iv) is a component represented by formula (II), where each of $B_1$, $B_2$ and $B_3$ represent H;

each of m, n or l independently represents a number from 0 to 40, the sum of m, n, l being in the range of 2 to 100, preferably 2 to 40;

R' represents H or $CH_3$, preferably H, characterized in that in the acyl group represented by —CO—R, R represents a linear or branched alkyl or alkenyl group comprising from 3 to 21 carbon atoms, preferably from 5 to 17 carbon atoms.

In a preferred embodiment of the invention, component b) according to the invention comprises at least two different components of formula (II): one of formula (i), (ii) or (iii), and another of formula (iv); the weight ratio of components [(i)+(ii)+(iii)]/(iv) being between 30.0:0.3 and 0.5:3.0.

In a more preferred embodiment of the invention, component b) according to the invention comprises components of formulas (i), (ii), (iii) and (iv); the weight ratio of components [(i)+(ii)+(iii)]/(iv) being between 15:0.3 and 1:3.0.

The degree of alkoxylation, i.e., the sum of m, n and l, is also preferably comprised between 2 and 100, more preferably 2 and 40, even more preferably between 3 and 30, even more preferably between 4 and 25.

In a preferred embodiment, the degree of alkoxylation i.e., the sum of m, n and l is comprised between 10 and 100, and the weight ratio of components [(i)+(ii)+(iii)]/(iv) is greater than 50.

In another preferred embodiment of the invention the degree of alkoxylation i.e., the sum of m, n and l, is comprised between 3 and 7, and the weight ratio of components [(i)+(ii)+(iii)]/(iv) is less than 50.

Examples of commercially available ethoxylated glycerol compounds according to the invention are the surfactants with commercial references Levenol® C-421 (INCI name Glycereth-2 Cocoate), Levenol® H&B (INCI name Glycereth-2 Cocoate), Levenol® F-200 (INCI name Glycereth-6 Cocoate), Levenol® C-301 (INCI name Glycereth-7 Cocoate), EMANON® HE (INCI name Glycereth-7 Cocoate), Levenol® C-201 (INCI name Glycereth-17 Cocoate), EMANON® XLF (INCI name Glycereth-7 Caprylate/Caprate), EMANON® EVE (INCI name Glycereth-7 Caprate/Caprylate).

c) Organic Solvent

The present invention comprises a solvent component c) comprising c.1. glycerol c.2. optionally one or more organic solvents other than glycerol In a preferred embodiment, component c) comprises c.1. glycerol c.2. optionally one or more organic solvents other than glycerol with a c.1:c.2 weight ratio greater than 1.5, preferably greater than 2, more preferably greater than 2.4.

In a more preferred embodiment, component c) consists of c.1. glycerol, and c.2. one or more organic solvents not comprising propylene glycol.

In another preferred embodiment, component c) consists of glycerol.

c.2. Organic Solvent Other than the Glycerol

The present invention comprises a component (c) which optionally comprises an organic solvent other than the glycerol. Examples of c.2 solvents according to the invention include ethanol, isopropanol, 1,2-propanediol, 1,3-propanediol, propylene glycol, dipropylene glycol, methylpropanediol and mixtures thereof. Can also be used other $C_1$-$C_4$ alcohols, $C_1$-$C_4$ alkanolamines, such as monoethanolamine, diethanolamine, methyldiethanolamine, methylisopropylamine and triethanolamine and mixtures thereof.

In a preferred embodiment of the invention, solvent c) according to the invention is chosen from propylene glycol, dipropylene glycol, methylpropanodiol, monoethanolamine, diethanolamine, methyldiethanolamine and triethanolamine, more preferably propylene glycol, monoethanolamine and triethanolamine.

e) Fatty Acid

The present invention optionally comprises a partially or fully neutralized fatty acid. According to the invention, the fatty acids are preferably selected with a number of carbon atoms between 6 and 22. $C_6$-$C_{22}$ fatty acids can be selected from a natural and/or synthetic origin. Natural acids are not usually produced in pure form, and therefore they are preferably used for the purposes of the invention in the form of mixtures. Accordingly, the fatty acids are preferably selected from hexanoic acid; heptanoic acid; octanoic acid; nonanoic acid; 9-hexadecenoic acid; 9,12-octadecadienoic acid; 9,12,15-octadecatrienoic acid; 5,8,11,14-eicosatetraenoic acid; 4,8,12,15,19-docosapentaenoic acid; coconut oil acid; oleic acid; resin oil acid; sunflower oil acid; linseed oil acid; and/or rapeseed oil acid.

In one embodiment of the invention, the $C_6$-$C_{22}$ fatty acids are optionally alkoxylated, preferably ethoxylated with 1 to 20 moles of ethylene oxide, preferably with 1 to 10 moles of ethylene oxide.

In a different embodiment of the invention, the $C_6$-$C_{22}$ fatty acids are not ethoxylated.

Composition of the Invention

The compositions according to the invention provide a liquid detergent composition comprising:

a) at least one anionic surfactant, b) at least one ethoxylated glycerol compound comprising at least one component of formula (II)

(II)

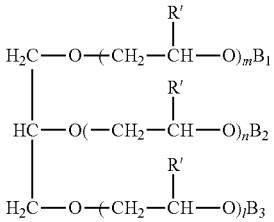

as defined herein, c) at least one organic solvent comprising c1. glycerol c2. optionally one or more organic solvents other than glycerol d) an amount of water not more than 10% by weight in relation to the entirety of the detergent composition, e) optionally, at least one partially or fully neutralized fatty acid.

In a preferred embodiment, the composition according to the present invention comprises:

e) at least one partially or fully neutralized fatty acid.

In a particular embodiment, the composition according to the invention comprises:

f) at least one sequestering agent, preferably phosphonate and/or citrate.

In another embodiment, the composition according to the invention comprises:

g) at least one optical brightener.

In one embodiment, the composition according to the invention comprises:

h) at least one or more enzymes

In a preferred embodiment of the invention, the compositions according to the invention comprise:

between 1% and 90%, preferably between 5% and 60%, more preferably between 10% and 40%, even more preferably between 20% and 30% of component a), between 1% and 90%, preferably between 5% and 60%, more preferably between 10% and 40%, more preferably between 16% and 35% of component b), and between 1% and 30%, preferably between 15% and 25%, of component c);

between 0% and 40% of component e), preferably between 5% and 30% by weight, more preferably between 8% and 25%, such ranges being mentioned considering that all of the acid is neutralized, in relation to the calculation of the molecular weight thereof, between 0% and 6% of component f), preferably between 0.05% and 5% between 0% and 1% of component g), preferably between 0.001% and 0.3%, between 0% and 3%, more preferably between 0.0001% and 2% of component h), preferably a mixture of protease, amylase and mannanase, each of the indicated amounts being expressed as a weight percentage of said active substance with respect to the total weight of the active material of the composition.

The weight ratio between component (a) and component (b) is preferably comprised between 0.5 and 2.0%.

The ratio between component e) (neutralized) and the sum of components a+b is comprised between 0 and 0.5.

Ingredients g), h) and i) used in preferred embodiments of the invention are defined below.

f) Sequestering Agent

The compositions of the present invention can optionally have a sequestering agent type additive.

Suitable sequestering agents include polycarboxylate type compounds. Sequestering agents for citrate, e.g., citric acid and soluble salts thereof (particularly sodium salt), are particularly preferred. Availability from renewable resources and biodegradability are of particular importance for the liquid detergent formulations for intensive cleaning. However, they present certain difficulties for being incorporated in formulations with low water content such as those described herein.

Other preferred sequestering agent type additives include ethylenediamine disuccinic acid and salts of thereof (ethylenediamine disuccinates, EDDS), ethylenediaminetetraacetic acid and salts of thereof (ethylenediaminetetraacetates, EDTA), and diethylenetriaminepentaacetic acid and salts thereof (ethylenetriamine pentaacetates, DTPA), hydroxyethylene diphosphonate (HEDP), ethylenediamine tetramethylene phosphonate (EDTMP), diethylenetriamine pentamethylene phosphonate (DTPMP), aluminosilicates such as zeolites A, B or MAP; fatty acids or salts, preferably sodium salts, thereof, preferably saturated and/or unsaturated $C_{12}$-$C_{18}$ fatty acids; and carbonates of alkaline or alkaline earth metals, preferably sodium carbonate.

g) Optical Brightening Agent

The compositions of the present invention also contain additional components that can dye items that are being cleaned, such as fluorescent brightening agent.

Any fluorescent brightening agent suitable for use in a detergent composition for clothes can be used in the composition of the present invention. Fluorescent brightening agents suitable include derivatives of diaminostilbene disulfonic acid and the alkaline metal salts thereof. Particularly preferred are 4,4'-bis(2-anilino-4-morpholino-1,3,5-triazinyl-6-amino)stilbene-2,2'-disulfonic acid salts, and related compounds in which the morpholino group is replaced with another moiety comprising nitrogen. Also preferred are 4,4'-bis(2-sulfostyryl)biphenyl type brighteners, which can optionally be combined with other brightening agents fluorescent brightening agents at the discretion of the formulator.

Typical fluorescent brightening agent levels in the preparations of the present invention range between 0.001% and 1%, although a level between 0.1% and 0.3%, by mass, is normally used. Commercial supplies of acceptable fluorescent brightening agent can be acquired, for example, from Ciba Specialty Chemicals (High Point, N.C.) and Bayer (Pittsburgh, Pa.).

h) Enzymes

The compositions of the present invention can contain one or more enzymes providing cleaning efficiency and/or fabric care benefits.

Detergent enzymes suitable for use in this invention include, but are not limited to, hemicellulases, peroxidases, proteases, other cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, [beta]-glucanases, arabinosidases, hyaluronidase, chondroitinase, laccase, and amylases, or mixtures thereof.

The enzymes can be used at the levels recommended by the suppliers, such as Novozymes and Genencor.

A typical combination is a enzyme cocktail which can comprise, for example, a protease in conjunction with an amylase.

When present in a cleaning composition, the aforementioned additional enzymes can be present at levels from about 0.00001% to about 2%, from about 0.0001% to about 1%, or even from about 0.0011 to about 0.5% of enzyme protein by weight of the composition.

Additives of the Composition According to the Invention

In addition to the previously mentioned essential elements, the composition according to the invention can comprise other components for the purpose of improving any technical aspect of the composition, such as stability, detergency or sensory aspects in connection with the perception of consumers.

Even though these elements do not have to be present to put the invention into practice, the use of materials of this type is often very useful for making the formulation acceptable during consumer use.

Examples of optional components include, without limitation: additional nonionic and anionic surfactants, amphoteric and hybrid ion surfactants, cationic surfactants, hydrotropes, fiber lubricant, reducing agents, enzyme stabilizing agents enzymes, defoamers, adjuvants, chemical brighteners, brightening catalysts, dirt removal agents, anti-redeposition agents, color transfer inhibitors, buffers, colorants, fragrances, pro-fragrances, rheology modifiers, polymers anti-incrustation, preservatives, insect repellent biocides, dirt repellents, water-resistant agents, suspension agents, aesthetic agents, structuring agents, sanitizers, textile material finishing agents, color fixing agents, wrinkle reducing agents, textile material conditioning agents and deodorants.

Perfume

The composition according to the invention can contain certain amounts of perfumes, fragrances, colorants or dyes or other components intended for improving its appearance or the sensory experience of the user or intended for resolving any practical issue.

Suitable examples of perfumes according to the invention include aldehydes, esters, ketones and the like.

The aldehydes suitable for the present invention can be one or more of, but not limited to, the following group of aldehydes: phenylacetaldehyde, p-methyl phenylacetaldehyde, p-isopropyl phenylacetaldehyde, methyl nonyl acetaldehyde, phenylpropanal, 3-(4-t-butylphenyl)-2-methylpropanal, 3-(4-t-butylphenyl)-propanal, 3-(4-methoxyphenyl)-2-methylpropanal, 3-(4-isopropylphenyl)-

2-methylpropanal, 3-(3,4-methylenedioxiphenyl)-2-methylpropanal, 3-(4-ethylphenyl)-2,2-dimethylpropanal, phenylbutanal, 3-methyl-5-phenylpentanal, hexanal, trans-2-hexenal, cis-hex-3-enal, hept anal, cis-4-heptenal, 2-ethyl-2-heptenal, 2,6-dimethyl-5-heptenal (melonal), 2,6-dimethylpropanal, 2,4-heptadienal, octanal, 2-octenal, 3,7-dimethyloctanal, 3,7-dimethyl-2,6-octadien-1-al, 3,7-dimethyl-1,6-octadien-3-al, 3,7-dimethyl-6-octenal, 3,7-dimethyl-7-hydroxyoctan-1-al, nonanal, 6-nonenal, 2,4-nonadienal, 2,6-nonadienal, decanal, 2-methyl decanal, 4-decenal, 9-decenal, 2,4-decadienal, undecanal, 2-methyl-decanal, 2-methylunidecanal, 2,6,10-trimethyl-9-undecenal, unidec-10-enyl aldehyde, undec-8-enanal, dodecanal, tridecanal, tetradecanal, anisaldehyde, bourgenonal, cinnamic aldehyde ald, α-amylcinnamaldehyde, α-hexyl cinnamaldehyde, methoxy cinnamaldehyde, citronellal, hydroxy-citronellal, isocyclocitral, citronellyl oxyacetaldehyde, cortexaldehyde, cumminic aldehyde, cyclamen aldehyde, florhydral, heliotropin, hydrotropic aldehyde, lilial, vanillin, ethyl vanillin, benzaldehyde, p-methyl benzaldehyde, 3,4-dimethoxybenzaldehyde, 3- and 4-(4-hydroxy-4-methylpentyl)-3-cyclohexene-1-carboxaldehyde, 2,4-dimethyl-3-cyclohexene-1-carboxaldehyde, 1-methyl-3-4-methylpentyl-3-cyclohexenecarboxaldehyde, and p-methylphenoxyacetaldehyde.

Examples of ketones suitable for the present invention can be one or more of, but not limited to, the following group of ketones: α-damascone, β-damascone, δ-damascone, β-damascenone, muscone, 6,7-dihydro-1,1,2,3,3-pentamethyl-4(5H)-indanone, cashmeran, cis-jasmone, dihydrojasmone, methyl dihydrojasmonate, α-ionone, β-ionone, dihydro-β-ionone, γ-methyl ionone, α-iso-methyl ionone, 4-(3,4-methylenedioxiphenyl) butan-2-one, 4-(4-hydroxyphenyl) butan-2-one, methyl β-naphthyl ketone, methyl cedryl ketone, 6-acetyl-1,1,2,4,4,7-hexamethyltetralin (tonalide), 1-carvone, 5-cyclohexadecen-1-one, acetophenone, decatone, 2-[2-(4-methyl-3-cyclohexenyl-1-yl) propyl]cyclopentan-2-one, 2-sec-butylcyclohexanone, β-dihydro ionone, allyl ionone, α-irone, α-ketone, α-irisone, acetanisole, geranyl acetone, 1-(2-methyl-5-isopropyl-2-cyclohexenyl)-1-propanone, acetyl diisoamylene, methyl cyclocitrone, 4-t-pentyl cyclohexanone, p-t-butylcyclohexanone, o-t-butylcyclohexanone, ethyl amyl ketone, ethyl pentyl ketone, menthone, methyl-7,3-dihydro-2H-1,5-benzodioxepine-3-one, fenchone, methyl naphthyl ketone, propyl naphthyl ketone and methyl hydroxynaphthyl ketone.

The present invention also provides a liquid unit dose comprising a water-soluble capsule with at least one compartment and a liquid housed therein, characterized in that said liquid is the liquid detergent composition according to the invention.

The composition according to the present invention is suitable for use in a water-soluble capsule or sachet. Said sachet is preferably formed from a film material which is soluble or dispersible in water. More preferably, the film has a water solubility of at least 50%, preferably of at least 75% or even of at least 95%. The preferred materials in the form of a sachet are polymer materials, preferably polymers that are formed in a film or sheet. The material in the form of a sachet can be obtained, for example, by casting, blow molding, extrusion or blow extrusion of the polymer material, as is known in the art. The preferred polymers, copolymers or derivatives thereof suitable for using as the material in the form of a sachet are selected from poly(vinyl alcohols), polyvinylpyrrolidone, poly(alkylene oxides), acrylamide, acrylic acid, cellulose, cellulose ethers, cellulose esters, cellulose amides, poly(vinyl acetates), polycarboxylic acids and salts, polyamino acids or peptides, polyamides, polyacrylamide, maleic/acrylic acid copolymers, polysaccharides including starch and gelatin, natural gums, such as xanthan and carrageenan, polyacrylates and water-soluble acrylate copolymers, methylcellulose, sodium carboxymethylcellulose, dextrin, ethylcellulose, hydroxyethylcellulose, hydroxy-propyl-methylcellulose, maltodextrin, polymethacrylates, and preferably selecting poly(vinyl alcohols), poly(vinyl alcohol) and hydroxy-propyl-methylcellulose (HPMC) copolymers and combinations thereof, known Monosol brand M8630PVA films, known films with commercial reference PT film or K series films marketed by Aicello, or VF-HP film marketed by Kuraray.

Other additives include functional detergent additives which are released into the washing water, for example, organic polymeric dispersants, etc.

The sachets can be of any size or shape, comprising at least one compartment. The compositions according to the invention are homogenous without having to use more than one compartment; however, they are compatible with capsules having two compartments, three compartments or multiple compartments.

The water-soluble capsule according to the invention is preferably a polyvinyl alcohol capsule.

The present invention also provides a method for preparing the liquid detergent compositions according to the invention which comprises mixing the components according to the invention at a temperature suitable for homogenization thereof, preferably at room temperature.

The present invention also provides a method for preparing the liquid unit dose according to the invention, which comprises encapsulating the liquid detergent composition in a water-soluble capsule.

Encapsulation Methods:

The encapsulation methods in the present invention refer to a complete loading or also a partial loading of the capsule. Air or another gas can also be trapped in the capsule.

The person skilled in the art knows encapsulation methods, and two possible encapsulation methods for encapsulating the liquid detergent composition in a water-soluble capsule are described by way of example.

(a) Horizontal Encapsulation

Water-soluble packages based on PVOH can be made according to any of the horizontal encapsulation methods described in any of patent documents WO-A-00/55044, WO-A-00/55045, WO-A-00/55046, WO-A-00/55068, WO-A-00/55069 and WO-A-00/55415.

By way of example, a thermoforming method in which a series of packages according to the invention is produced from two sheets of water-soluble material is described below. In this sense, recesses are formed in the sheet of film using a forming mold having a plurality of cavities with dimensions generally corresponding to the dimensions of the packages that will be produced. Furthermore, a single heating plate is used for thermoforming the film for all the cavities and a single sealing plate is described in the same manner.

A first sheet of PVOH film is extracted on a forming mold, such that the film is placed on the plurality of cavity formations in the mold. In this example, each cavity is generally dome-shaped, having a round edge; the edges of the cavities are furthermore rounded to remove all sharp edges that may damage the film during the sealing or forming steps of the method.

Each cavity also includes a raised flange surrounding it. For the purpose of maximizing package resistance, the film is released in the forming mold without any creases and with minimum tension. In the forming step, the film is heated to 100-120° C., preferably to about 110° C., for up to 5 seconds, preferably 700 microseconds. A heating plate is used to heat the film, where the plate is placed directly on the forming mold.

During this preheating step, a 50 kPa vacuum goes through the preheating plate to assure close contact between the film and the preheating plate; this close contact assures that the film is heated uniformly and homogenously (the extent of the vacuum depends on the thermoforming conditions and the type of film used; nevertheless, it was found that a vacuum less than 0.6 kPa was suitable in the present context).

Non-uniform heating results in a formed package having weak points. In addition to the vacuum, it is possible to insufflate air against the film to force close contact with the preheating plate.

The thermoformed film is molded in the cavities, which are removed by means of blowing the film of the heating plate and/or by means of absorbing the film in the cavities, such that a plurality of recesses is formed in the film, and once these recesses are formed, they are kept in their thermoformed orientation by means of applying a vacuum through the walls of the cavities. This vacuum is maintained at least until the packages are sealed.

Once the recesses have been formed and are kept in the position by means of the vacuum, a liquid detergent composition according to the invention is added to each of the recesses. Then, a second sheet of polyvinyl alcohol film is overlaid on the first line through the loaded recesses and is heat sealed using a sealing plate. In this case, the thermal heating plate, which is generally flat, works at a temperature of about 140-160° C. and puts the films in contact for 1 to 2 seconds with a force of 8 to 30 kg/cm$^2$, preferably from 10 to 20 kg/cm$^2$. The raised flanges surrounding each cavity assure that the films are sealed along the flange to form a continuous sac. The rounded edge of each cavity is at least partially formed by an elastically deformable material such as silicone rubber, for example. This results in applying less force on the inner edge of the sealing flange for preventing the damage caused by heat/pressure on the film.

Once sealed, the formed packages are separated from the sheet film network using cutting means. In this step, it is possible to release the vacuum in the mold and expel the formed packages from the forming mold. The packages are thereby formed, loaded and sealed while they are introduced in the forming mold. Furthermore, they can also be cut while they are in the forming mold.

During the forming, loading and sealing steps of the method, the relative humidity of the atmosphere is controlled to a humidity of about 50%. This is done to maintain the heat sealing features of the film. When thinner films are handled, it may be necessary to reduce the relative humidity to assure that the films have a relatively low degree of plasticization, and are therefore harder and easier to handle.

(b) Vertical Encapsulation

In the vertical encapsulation technique, continuous tube of flexible plastic film. It is sealed, preferably by heat or ultrasound sealing means, at the bottom, loaded with the liquid composition, sealed again above the liquid film, and then it is removed from the continuous tube by means of cutting, for example.

Persons skilled in the art will be familiar with encapsulation methods for other water-soluble films, such as films based on PVP or PEO.

The present invention also provides a method for cleaning clothes which comprises using water-soluble capsules containing a liquid detergent composition according to the invention.

EXAMPLES

1. Concentrated Liquid Detergent Compositions for Washing Clothes According to the Invention: Preparation, Appearance and Water Dissolving Capacity Tables 1-3 summarize the compositions according to the invention (1-8), as well as the comparative examples (C1-C5), indicating the percentages of active material of each of the ingredients.

The compositions are prepared at room temperature, following a normal process for mixing the components, stirring after each addition, until they are completely homogenized.

Tables 1-3 also summarize the appearance and water dissolving capacity of the concentrated compositions.

The appearance is evaluated visually at room temperature, designating the appearance in which the formula is transparent and homogenous as "correct", and as "incorrect" if the composition shows cloudiness or phase separation.

The water dissolving capacity is evaluated visually and corresponds to the time it takes the detergent composition to completely dissolve in water. 0.5 g of the composition to be evaluated are weighed on a glass container having a height of 1.5 cm. Said container is in turn introduced in the base of a second large-sized glass container. 1000 mL of water with hardness 20° HF (544 ppm $Ca^{2+}$ and 156 ppm $Mg^{2+}$) are introduced in this second container, allowing it to slide slowly down the wall to prevent turbulences (speed around 3.0-3.5 mL/s). One minute after adding water, the mixture is stirred at 200 rpm until the composition to be evaluated is completely dissolved. It is considered that the dissolution in water is correct when the time does not exceed 160 s (average time corresponding to liquid detergent compositions for water-soluble capsules present on the market).

The results shown in Table 1 show that the compositions according to the invention (1,3) have a transparent and homogenous appearance, unlike comparative examples C2 and C3 based on ethoxylated fatty alcohol as a nonionic surfactant alternative to the ethoxylated glycerol compound. In the case of Comparative Example C1, in which ethoxylated fatty alcohol is used, a transparent and homogenous formulation is achieved by introducing a glycol type solvent in the composition. The dissolving capacity of those compositions having a transparent and homogenous appearance is correct in all the cases.

The composition according to the invention (2) also allows incorporating citrate sodium without losing the appearance and water dissolving capacity required for products of this type.

TABLE 1

| Chemical description | C1 % | C2 % | C3 % | 1 % | 2 % | 3 % |
|---|---|---|---|---|---|---|
| Dodecylbenzene sulfonic acid [1] | 23.0 | 23.0 | 27.9 | 23.0 | 23.0 | 27.9 |
| C13-15 alcohol 7EO [2] | 18.2 | 18.2 | 22.1 | 0.0 | 0.0 | 22.1 |
| Glycereth-6 Cocoate [3] | 0.0 | 0.0 | 0.0 | 18.2 | 18.2 | 22.1 |
| Coconut fatty acid | 14.9 | 14.9 | 7.4 | 14.9 | 14.9 | 7.4 |
| Monoethanolamine (MEA) | 9.0 | 9.0 | 8.1 | 9.0 | 9.0 | 8.1 |
| Sodium citrate•$2H_2O$ | 0.0 | 0.0 | 0.0 | 0.0 | 4.0 | 0.0 |
| Phosphonate [4] | 0.50 | 0.50 | 0.50 | 0.50 | 0.25 | 0.50 |
| Optical brightener [5] | 0.15 | 0.15 | 0.15 | 0.15 | 0.15 | 0.15 |
| Propylene glycol | 11.5 | 0.00 | 0.00 | 0.00 | 0.00 | 0.00 |
| Glycerol | 11.5 | 23.0 | 23.0 | 23.0 | 21.0 | 23.0 |
| Water | 6.5 | 6.5 | 6.0 | 6.5 | 7.6 | 6.0 |
| Enzymes (protease, amylase, mannanase) | 1.6 | 1.6 | 1.6 | 1.6 | 1.6 | 1.6 |

TABLE 1-continued

| Chemical description | C1 % | C2 % | C3 % | 1 % | 2 % | 3 % |
|---|---|---|---|---|---|---|
| Perfume, colorants, minor components | to 100 | to 100 | to 100 | to 100 | to 100 | to 100 |
| pH (100%) | between 7.5-8.5 | | | | | |
| Appearance at room temperature | ○ | X | X | ○ | ○ | ○ |
| Water dissolving capacity | ○ | — | — | ○ | ○ | ○ |

[1] SULFONAX at 95% a.m. supplied by KAO Chemicals Europe
[2] FINDET 1315/19 supplied by KAO Chemicals Europe
[3] LEVENOL F-200 supplied by KAO Chemicals Europe
[4] Sodium diethylenetriamine penta(methylene phosphonate)
[5] 4,4-Distyryl biphenyl derivative (DSBP)

Notes:

The percentages shown in the table correspond to active material.

As regards appearance, the symbol "O" corresponds to transparent and stable compositions and "X" corresponds to non-homogenous compositions that present cloudiness or phase separation.

The water dissolving capacity is considered suitable "O" when it is at the level of products on the market.

2. Concentrated Liquid Detergent Compositions for Washing Clothes According to the Invention: Effect of the Chemical Characteristics of Ethoxylated Glycerol Compounds Table 2 shows different examples of compositions according to the invention (4-6) in which the structural and chemical characteristics (length of chain of the ester and degree of ethoxylation) of ethoxylated glycerol compounds are changed.

TABLE 2

| Chemical description | 4 % | 5 % | 6 % |
|---|---|---|---|
| Dodecylbenzene sulfonic acid [1] | 23.0 | 23.0 | 23.0 |
| Glycereth-7 Cocoate [2] | 18.2 | 0.0 | 0.0 |
| Glycereth-17 Cocoate [3] | 0.0 | 18.2 | 0.0 |
| Glycereth-7 Caprylate/Caprate [4] | 0.0 | 0.0 | 18.2 |
| Coconut fatty acid | 14.9 | 14.9 | 14.9 |
| Monoethanolamine (MEA) | 9.0 | 9.0 | 9.0 |
| Phosphonate [5] | 0.50 | 0.50 | 0.50 |
| Optical brightener [6] | 0.15 | 0.15 | 0.15 |
| Glycerol | 23.0 | 23.0 | 23.0 |
| Water | 6.5 | 6.5 | 6.5 |
| Enzymes (protease, amylase, mannanase) | 1.6 | 1.6 | 1.6 |
| Perfume, colorants, minor components | to 100 | to 100 | to 100 |
| pH (100%) | between 7.5-8.5 | | |
| Appearance at room temperature | ○ | ○ | ○ |
| Water dissolving capacity | ○ | ○ | ○ |

[1] SULFONAX at 95% a.m. supplied by KAO Chemicals Europe
[2] LEVENOL C-301 supplied by KAO Chemicals Europe
[3] LEVENOL C-201 supplied by KAO Chemicals Europe
[4] EMANON XLF supplied by KAO Chemicals Europe
[5] Sodium diethylenetriamine penta(methylene phosphonate)
[6] 4,4-Distyryl biphenyl derivative (DSBP)

3. Concentrated Liquid Detergent Compositions for Washing Clothes According to the Invention, Based on Laureth Sulfate Table 3 shows some examples of compositions in which laureth sulfate is used as the anionic surfactant. Examples 7 and 8 based on glycereth-6 cocoate provide homogenous and stable formulations with good dissolving capacity. In contrast, Comparative Examples C4 and C5, based on ethoxylated fatty alcohol, give rise to non-homogenous formulations, even when using glycol type solvents in the composition (as in the case of Comparative Example C4).

TABLE 3

| Chemical description | C4 % | C5 % | 7 % | 8 % |
|---|---|---|---|---|
| Sodium laureth sulfate [1] | 20.4 | 20.4 | 20.4 | 20.4 |
| C13-15 alcohol 7EO [2] | 34.8 | 34.8 | 0.0 | 0.0 |
| Glycereth-6 Cocoate [3] | 0.0 | 0.0 | 34.8 | 34.8 |
| Coconut fatty acid | 5.5 | 5.5 | 5.5 | 5.5 |
| Triethanolamine (TEA) | 9.8 | 9.8 | 9.8 | 9.8 |
| Phosphonate [4] | 0.25 | 0.25 | 0.25 | 0.25 |
| Optical brightener [5] | 0.10 | 0.10 | 0.10 | 0.10 |
| Propylene glycol | 9.0 | 0.0 | 9.0 | 0.0 |
| Water | 9.0 | 18.0 | 9.0 | 18.0 |
| Enzymes (protease, amylase, mannanase) | 1.6 | 1.6 | 1.6 | 1.6 |
| Perfume, colorants, minor components | to 100 | to 100 | to 100 | to 100 |
| pH (100%) | between 7.5-8.5 | | | |
| Appearance at room temperature | X | X | ○ | ○ |
| Water dissolving capacity | — | — | ○ | ○ |

[1] EMAL 270 at 70% a.m. supplied by KAO Chemicals Europe
[2] FINDET 1315/19 supplied by KAO Chemicals Europe
[3] LEVENOL F-200 supplied by KAO Chemicals Europe
[4] Sodium diethylenetriamine penta(methylene phosphonate)
[5] 4,4-Distyryl biphenyl derivative (DSBP)

4. Detergency of the Compositions According to the Invention

Table 4 summarizes the experimental data corresponding to the evaluation of the detergent efficacy. Said efficacy is established by determining the percentage of elimination of dirt present in standard fabric samples. The efficacy tests are carried out using a Miele Softtronic W5722 front-loading washing machine in the following conditions: synthetic/mix program, spin speed 800 rpm, washing water temperature 20° C., water hardness 20° HF (544 ppm $Ca^{2+}$ and 156 ppm $Mg^{2+}$), 2 kg pre-discharged cotton towel load and 35 grams of the detergent to be evaluated. Different types of standard dirt are used in each detergency test, placing 3 specimens (5×5 cm dimensions) of each type of fabric in each wash.

After the washing step, the fabric samples are left to air-dry at room temperature.

Detergent efficacy is determined by means of colorimetric measurements on the standard dirty fabric before and after the washing process. These measurements are taken using a colorimeter, for example Datacolor International Spectraflash 600.

Detergent efficacy is expressed as % detergency, calculated from the following mathematical formula, in which the CIE L* (Lightness) parameter, which is from the colorimetric measurement, is involved.

$$\%\ \text{detergency} = \frac{L^*_{washed\ dirty\ fabric} - L^*_{unwashed\ dirty\ fabric}}{L^*_{unwashed\ ,nondirty\ fabric} - L^*_{unwashed\ dirty\ fabric}} \cdot 100$$

The percentage of detergency detailed in the table corresponds to the average value corresponding to the three specimens used for each type of fabric.

The values shown in Table 4 demonstrate that the composition according to the invention (Example 1) has suitable cleaning power.

TABLE 4

| % Detergency | |
|---|---|
| Standard fabric reference | 1 % |
| E-101 | 37 |
| wfk-10TE | 57 |
| E-123 | 50 |
| E-104 | 42 |

E-101 Olive oil/Activated carbon on cotton supplied by Empa Testmaterials
E-104 Olive oil/Activated carbon on cotton/polyester supplied by Empa Testmaterials
wfk-10TE Clay on cotton supplied by Empa Testmaterials
E-123 Mixture of dirt specific for evaluating the low-temperature detergency on cotton fabric, supplied by EMPA Testmaterials

The invention claimed is:

1. A liquid detergent composition comprising:

a) at least one anionic surfactant, b) at least one ethoxylated glycerol compound comprising at least one component of formula (II)

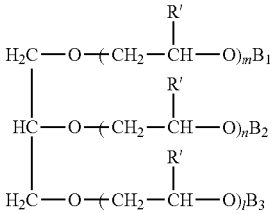

(II)

where said formula (II) comprises the components of formula i), ii), iii) and/or iv), wherein i) is a component represented by formula (II), where one of the symbols $B_1$, $B_2$, $B_3$ independently represents an acyl group —CO—R and the others represent H;

ii) is a component represented by formula (II), where two of the symbols $B_1$, $B_2$, $B_3$ independently represent an acyl group —CO—R and the other represents H;

iii) is a component represented by formula (II), where each of the symbols $B_1$, $B_2$, $B_3$ independently represents an acyl group —CO—R;

iv) is a component represented by formula (II), where each of $B_1$, $B_2$ and $B_3$ represents H;

each of m, n or l independently represents a number from 0 to 40, the sum of m, n, and l being in the range of 2 to 100;

R' represents H or $CH_3$, and

R represents a linear or branched alkyl or alkenyl group comprising from 3 to 21 carbon atoms, c) at least one organic solvent comprising c1) glycerol, and c2) optionally one or more organic solvents other than glycerol, d) an amount of water not more than 10% by weight in relation to the entirety of the detergent composition, e) optionally, a partially or fully neutralized fatty acid.

2. The liquid detergent composition according to claim 1, wherein component b) comprises at least two different components of formula (II): one of formula (i), (ii) or (iii), and another of formula (iv), the weight ratio of components [(i)+(ii)+(iii)]/(iv) being between 30.0:0.3 and 0.5:3.0.

3. The liquid detergent composition according to claim 1, wherein the sum of m, n and l is comprised between 10 and 100 and the weight ratio of components [(i)+(ii)+(iii)]/(iv) is greater than 50.

4. The liquid detergent composition according to claim 1, additionally comprising:

a) at least one sequestering agent, preferably phosphonate and/or citrate.

5. The composition according to claim 1, additionally comprising:

b) at least one optical brightener.

6. The composition according to claim 1, additionally comprising:

c) at least one or more enzymes.

7. The composition according to claim 1, wherein component a) is selected from alkyl ether sulfates, alkyl ether carboxylic acids and and/or their salts and sulfosuccinates, more preferably alkyl ether sulfates.

8. The composition according to claim 1, wherein the c1:c2 weight ratio is greater than 1.5.

9. The composition according to claim 8, wherein the c1:c2 ratio is greater than 2, more preferably greater than 2.4.

10. The composition according to claim 1, wherein solvent c2 is not propylene glycol.

11. A method for preparing the liquid detergent compositions having components as defined in claim 1, which comprises mixing the components a temperature suitable for homogenization thereof, preferably at room temperature.

12. A liquid unit dose comprising a water-soluble capsule having at least one compartment and a liquid housed therein, characterized in that said liquid is a liquid detergent composition according to claim 1.

13. The liquid unit dose according to claim 12, wherein the water-soluble capsule is a polyvinyl alcohol capsule.

14. A method for preparing a liquid unit dose as defined in claim 12, which comprises encapsulating the liquid detergent composition in a water-soluble capsule.

15. A method for cleaning clothes which comprises contacting the clothes with the liquid unit doses defined in claim 12.

16. A method for cleaning clothes which comprises contacting the clothes with the liquid detergent composition according to claim 1.

* * * * *